US009514597B2

(12) United States Patent
Schwartz

(10) Patent No.: US 9,514,597 B2
(45) Date of Patent: Dec. 6, 2016

(54) GAMING CHIP AND SYSTEM FOR USE THEREWITH

(75) Inventor: Andrew J. Schwartz, Chester Springs, PA (US)

(73) Assignee: Global Payments Gaming Services, Inc., Las Vegas, NV (US)

( * ) Notice: Subject to any disclaimer, the term of this patent is extended or adjusted under 35 U.S.C. 154(b) by 1211 days.

(21) Appl. No.: 12/511,369

(22) Filed: Jul. 29, 2009

(65) Prior Publication Data

US 2011/0028204 A1 Feb. 3, 2011

(51) Int. Cl.

| | |
|---|---|
| ***A63F 9/24*** | (2006.01) |
| ***G07F 17/32*** | (2006.01) |
| ***G07F 1/06*** | (2006.01) |

(52) U.S. Cl.

CPC ..... *G07F 17/32* (2013.01); *G07F 1/06* (2013.01); *G07F 17/3244* (2013.01); *G07F 17/3248* (2013.01); *G07F 17/3251* (2013.01)

(58) Field of Classification Search

CPC .. G07F 17/32; G07F 17/3244; G07F 17/3248; G07F 17/3251

USPC ... 463/25, 42, 16, 20, 29; 273/138.1, 148 R, 273/139; 705/35

See application file for complete search history.

(56) References Cited

U.S. PATENT DOCUMENTS

| | | | | |
|---|---|---|---|---|
| 6,200,218 | B1 * | 3/2001 | Lindsay | G07F 17/32 273/148 R |
| 6,629,591 | B1 * | 10/2003 | Griswold et al. | 194/205 |
| 7,267,614 | B1 * | 9/2007 | Jorasch et al. | 463/25 |
| 7,491,125 | B2 * | 2/2009 | Mathis | G07F 17/32 463/47 |
| 7,549,920 | B2 * | 6/2009 | Jorasch et al. | 463/16 |
| 7,753,779 | B2 * | 7/2010 | Shayesteh | 463/25 |
| 7,878,896 | B2 * | 2/2011 | Jorasch et al. | 463/20 |
| 7,883,408 | B2 * | 2/2011 | Gelinotte | 463/25 |
| 8,029,357 | B2 * | 10/2011 | Jorasch et al. | 463/25 |
| 8,167,705 | B2 * | 5/2012 | Jorasch et al. | 463/25 |
| 2001/0034265 | A1 * | 10/2001 | Rowe | G07F 17/3246 463/25 |
| 2002/0147042 | A1 * | 10/2002 | Vuong et al. | 463/40 |
| 2003/0119584 | A1 * | 6/2003 | Rowe | G07F 17/3246 463/25 |

(Continued)

*Primary Examiner* — William H McCulloch, Jr.
*Assistant Examiner* — Chase Leichliter
(74) *Attorney, Agent, or Firm* — Mendelsohn Dunleavy, P.C.; Steve Mendelsohn

(57) ABSTRACT

A computer-implemented interactive system and methods allowing for the tracking, management, and reporting of casino smart chips are provided. In an illustrative implementation a casino smart chip environment comprises a casino smart chip management engine, and instruction set comprising at least one instruction to instruct the casino smart chip engine to process data representative of the activation, tracking, monitoring, and/or reporting of one or more casino smart chips. In the illustrative implementation, the one or more casino smart chips can comprise one or more operative components comprising any of a communications component (e.g., radio frequency identification (RFID) component), a display component, a monetary value store, and a unique identifier store. Operatively, the exemplary casino smart chip engine can track, store, and report data representative of the authentication, commissioning, draw down, decommissioning, and use of the smart casino chip in casino and non-casino activities.

40 Claims, 8 Drawing Sheets

(56) References Cited

U.S. PATENT DOCUMENTS

| | | | | |
|---|---|---|---|---|
| 2004/0087375 | A1* | 5/2004 | Gelinotte | G06K 7/08 463/47 |
| 2006/0121984 | A1* | 6/2006 | Jorasch et al. | 463/29 |
| 2006/0217185 | A1* | 9/2006 | Cavagna | 463/25 |
| 2006/0273181 | A1* | 12/2006 | Charlier et al. | 235/492 |
| 2006/0287078 | A1* | 12/2006 | Smolucha et al. | 463/29 |
| 2007/0026949 | A1* | 2/2007 | Charlier | G06K 19/07796 463/47 |
| 2007/0060307 | A1* | 3/2007 | Mathis | G07F 17/32 463/25 |
| 2007/0060311 | A1* | 3/2007 | Rowe et al. | 463/25 |
| 2007/0094721 | A1* | 4/2007 | Nguyen | G06Q 50/34 726/9 |
| 2007/0197299 | A1* | 8/2007 | Miller et al. | 463/43 |
| 2007/0293309 | A1* | 12/2007 | Jorasch et al. | 463/25 |
| 2008/0113783 | A1* | 5/2008 | Czyzewski et al. | 463/29 |
| 2009/0042642 | A1* | 2/2009 | Nissen | 463/25 |
| 2009/0149247 | A1* | 6/2009 | Esbensen | G07F 17/3239 463/29 |
| 2010/0093428 | A1* | 4/2010 | Mattice et al. | 463/25 |
| 2010/0285869 | A1* | 11/2010 | Walker | G07F 17/32 463/25 |

* cited by examiner

GAMING CHIP AND SYSTEM FOR USE THEREWITH

BACKGROUND

The ability to manage casino chips has become increasingly more important to reduce fraud and to obtain insight about the activity of a casino chip as it makes its way through a casino environment or, if allowed, its use in non-casino environments. Currently, casino operators rely on unique logos, colors, print, numbers, or a combination thereof to identify the source and/or origin of a casino chip and, if sophisticated enough, a very general understanding of how a casino chip migrates across a casino environment and/or non-casino environment. For example, a casino can deploy various number encoded casino chips which can be directed for use in selected casino and/or non-casino areas. For example, a first set of casino chips might have a first number sequence which indicates that these casino chips should be deployed for use in the poker tables, a second number sequence which indicates that the casino chips should be deployed for use in craps gaming tables. A casino operator can then examine the collection boxes from each of the various casino sectors to see if casino chips have migrated between sections. That is, in general terms, how many casino chips deployed for the poker tables ended up in blackjack table collection boxes. Armed with this information, general assumptions can be derived about the activity of a gamer in a casino.

Casino operators have also made extensive use of bar-coded vouchers, which operate as a substitute for cash at automated gaming machines (such as slot and video poker machines) and can be exchanged for chips at a gaming table. Vouchers provide a number of benefits over cash or conventional gaming chips because the bar-code is machine readable. Vouchers suffer, however, from a number of drawbacks. Because vouchers are made of paper, they are not durable and can be rendered unreadable if crumpled, torn or stained. For this reason, vouchers are generally used only once. In addition, the bar-code on a voucher is capable of holding very little information and is relatively easy to duplicate. As an improvement to conventional chips and paper vouchers, recent practices employ casino smart chips which include electronic transceivers (e.g., RFID transceivers) which have allowed casino operators to better manage and track casino chips in both casino and non-casino environments. However, existing casino smart chips are currently deployed and focused on providing secure monetization of the chip. Specifically, currently deployed casino smart chips are provided to ensure that that the chip is not fraudulent when a casino cashes out to the player holding the chip. Current practices, however, fall short to provide comprehensive systems and methods that allow for the tracking, management, reporting, provisioning, activation, commissioning, and decommissioning of casino smart chips under a central casino smart chip management platform. Additionally, current practices fall short to provide capabilities to collect and process casino smart chips to generate demographic data for use in identifying popular casino and non-casino product/service offerings. Further, current practices fall short to provide capabilities to identify geographic location of a casino smart chip within a casino environment (i.e., whether the casino chip has left a casino environment).

From the foregoing, it is appreciated that there exists a need for systems and methods that ameliorate the shortcomings of existing practices.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The herein described systems and methods provide a computer-implemented interactive system and methods allowing for the tracking, management, and reporting of casino smart chips. In an illustrative implementation a casino smart chip environment comprises a casino smart chip management engine, an instruction set comprising at least one instruction to instruct the casino smart chip engine to process data representative of the activation, tracking, monitoring, and/or reporting of one or more casino smart chips. In the illustrative implementation, the one or more casino smart chips can comprise one or more operative components comprising any of a communications component (e.g., radio frequency identification (RFID) component), a display component, a monetary value store, and a unique identifier store.

In an illustrative operation, a casino smart chip can be provisioned to represent a selected monetary value. In the illustrative operation, the casino smart chip can maintain the provisioned monetary value in the exemplary casino smart chip's monetary value store and can be validated within the exemplary casino smart chip environment by associating a unique identifier to the casino smart chip. Illustratively, the casino smart chip unique identifier can be maintained by the casino smart chip in the casino smart chip's unique identifier store. Further, in the illustrative implementation, the casino smart chip can operatively display the stored monetary value on the casino smart chip's display component.

In another illustrative operation, the exemplary casino smart chip engine can process data representative of the use of one or more casino smart chips in an exemplary casino (e.g., gaming context). In the illustrative operation, one or more casino smart chip receptacles, cooperating with exemplary casino smart chip engine, can operate to receive one or more casino smart chips as part of a gaming session. Operatively, the exemplary smart casino engine can process data received from the one or more casino smart chip receptacles to commission, draw down, decommission, report, and track casino smart chips used in the casino environment.

In another illustrative operation, the exemplary casino smart chip engine can process data representative of the use of one or more smart casino chips in a non-gaming environment (e.g., non-casino environment). In the illustrative operation, one or more cooperating parties (e.g., food service providers, security mechanisms, travel administrators, etc.) can illustratively process one or more casino smart chips and cooperate with exemplary casino smart chip engine to track non-casino use of the one or more smart casino chips to generate demographic data for subsequent use by a casino operator.

The following description and the annexed drawings set forth in detail certain illustrative aspects of the subject matter. These aspects are indicative, however, of but a few of the various ways in which the subject matter can be employed and the claimed subject matter is intended to include all such aspects and their equivalents.

BRIEF DESCRIPTION OF THE DRAWING(S)

DETAILED DESCRIPTION OF THE PREFERRED EMBODIMENT(S)

Figure 1:
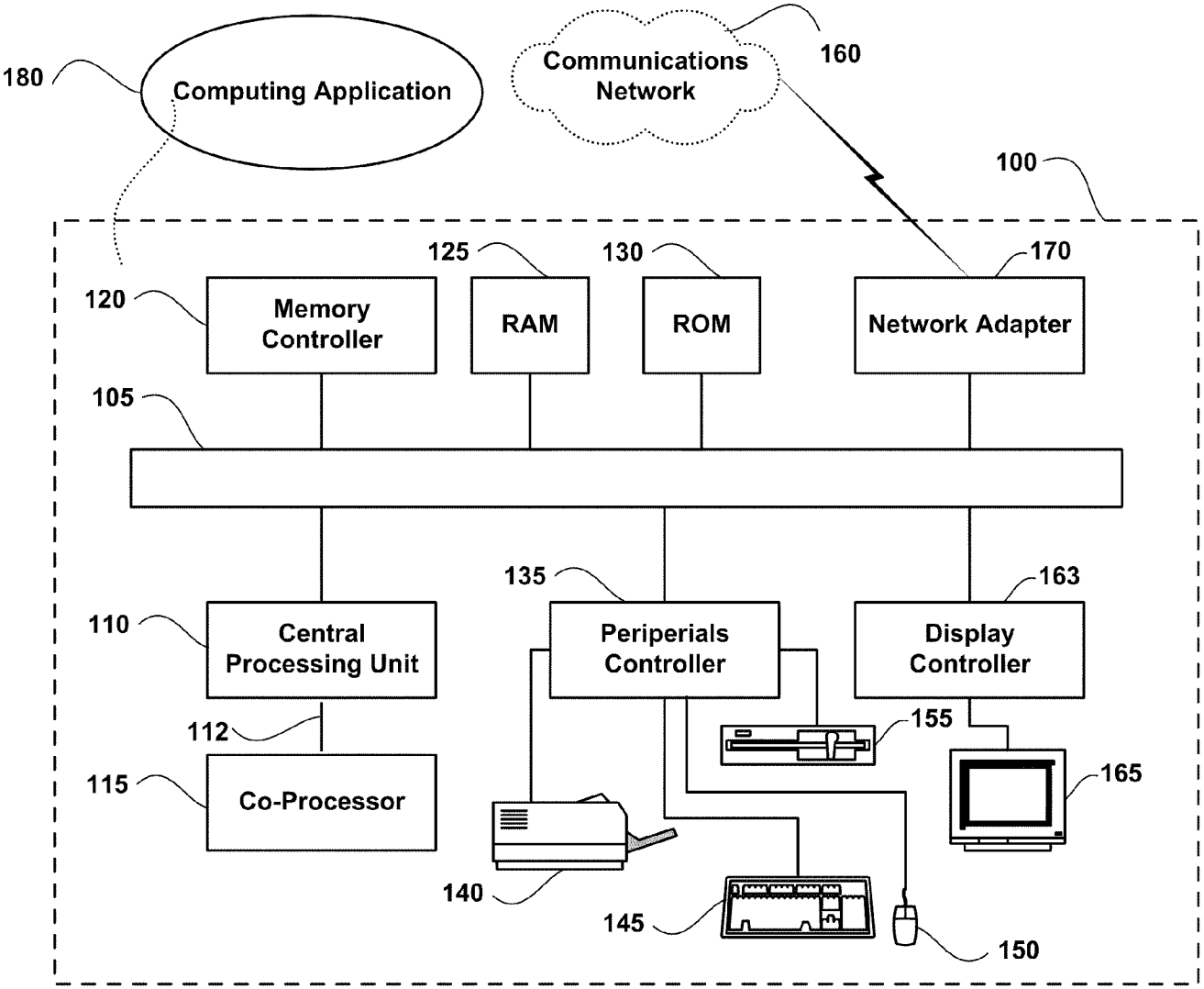
FIG. 1 is a block diagram of an exemplary computing environment in accordance with an illustrative implementation of the herein described systems and methods.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, well-known structures and devices are shown in block diagram form in order to facilitate describing the claimed subject matter.

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Moreover, the terms "system," "component," "module," "interface," "model" or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Although the subject matter described herein may be described in the context of illustrative illustrations to process one or more computing application features/operations for a computing application having user-interactive components the subject matter is not limited to these particular embodiments. Rather, the techniques described herein can be applied to any suitable type of user-interactive component execution management methods, systems, platforms, and/or apparatus.

Illustrative Computing Environment:

FIG. 1 depicts an exemplary computing system 100 in accordance with herein described system and methods. The computing system 100 is capable of executing a variety of computing applications 180. Computing application 180 can comprise a computing application, a computing applet, a computing program and other instruction set operative on computing system 100 to perform at least one function, operation, and/or procedure. Exemplary computing system 100 is controlled primarily by computer readable instructions, which may be in the form of software. The computer readable instructions can contain instructions for computing system 100 for storing and accessing the computer readable instructions themselves. Such software may be executed within central processing unit (CPU) 110 to cause the computing system 100 to do work. In many known computer servers, workstations and personal computers CPU 110 is implemented by micro-electronic chips CPUs called microprocessors. A coprocessor 115 is an optional processor, distinct from the main CPU 110 that performs additional functions or assists the CPU 110. The CPU 110 may be connected to co-processor 115 through interconnect 112. One common type of coprocessor is the floating-point coprocessor, also called a numeric or math coprocessor, which is designed to perform numeric calculations faster and better than the general-purpose CPU 110.

In operation, the CPU 110 fetches, decodes, and executes instructions, and transfers information to and from other resources via the computer's main data-transfer path, system bus 105. Such a system bus connects the components in the computing system 100 and defines the medium for data exchange. Memory devices coupled to the system bus 105 include random access memory (RAM) 125 and read only memory (ROM) 130. Such memories include circuitry that allows information to be stored and retrieved. The ROMs 130 generally contain stored data that cannot be modified. Data stored in the RAM 125 can be read or changed by CPU 110 or other hardware devices. Access to the RAM 125 and/or ROM 130 may be controlled by memory controller 120. The memory controller 120 may provide an address translation function that translates virtual addresses into physical addresses as instructions are executed.

In addition, the computing system 100 can contain peripherals controller 135 responsible for communicating instructions from the CPU 110 to peripherals, such as, printer 140, keyboard 145, mouse 150, and data storage drive 155. Display 165, which is controlled by a display controller 163, is used to display visual output generated by the computing system 100. Such visual output may include text, graphics, animated graphics, audio, and video. The display controller 163 includes electronic components required to generate a video signal that is sent to display 165. Further, the computing system 100 can contain network adaptor 170 which may be used to connect the computing system 100 to an external communication network 160.

Figure 2:
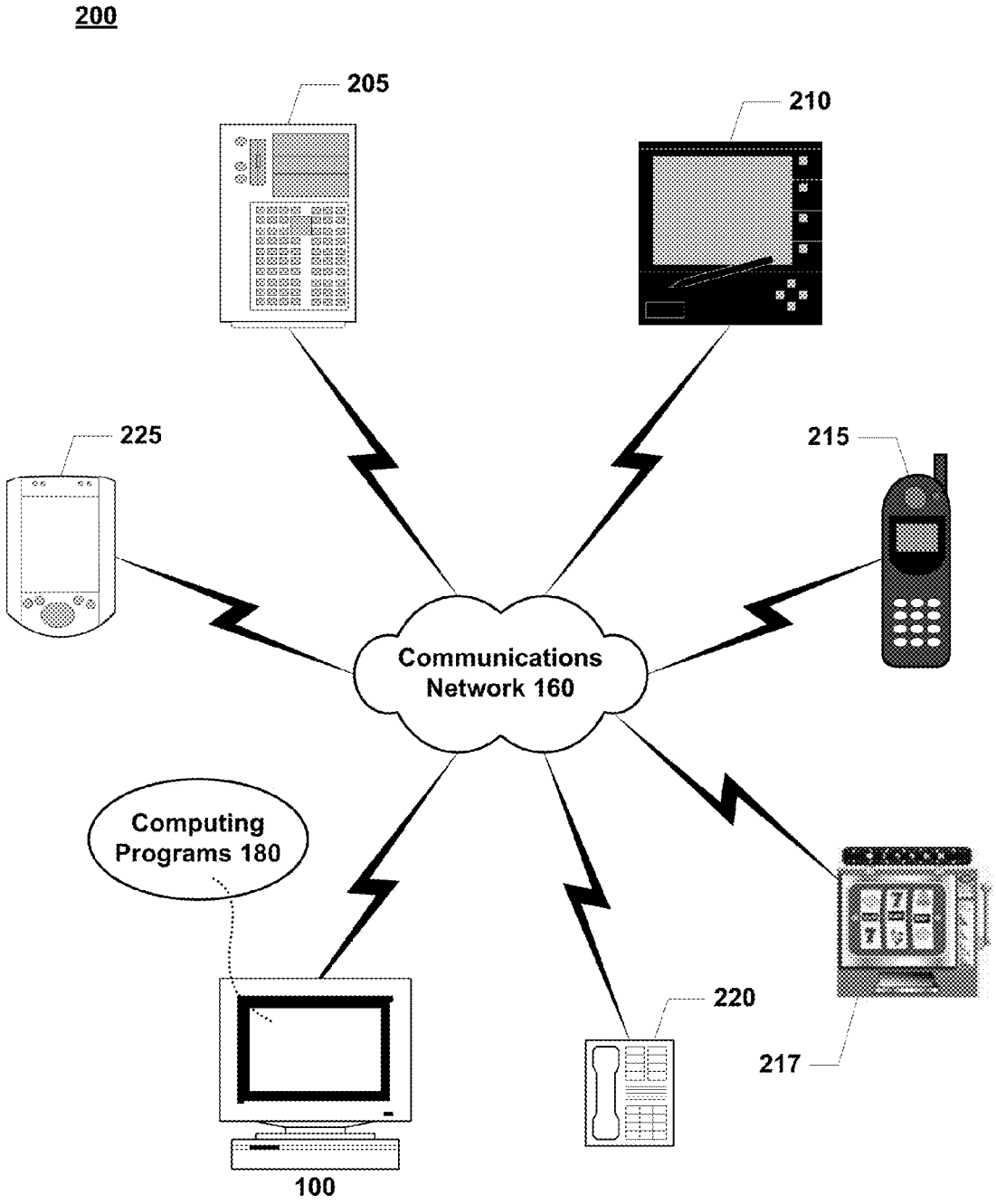
FIG. 2 is a block diagram of an exemplary networked computing environment in accordance with an illustrative implementation of the herein described systems and methods.

Illustrative Computer Network Environment:

Computing system 100, described above, can be deployed as part of a computer network. In general, the above description for computing environments applies to both server computers and client computers deployed in a network environment. FIG. 2 illustrates an exemplary illustrative networked computing environment 200, with a server in communication with client computers via a communications network, in which the herein described apparatus and methods may be employed. As shown in FIG. 2, server 205 may be interconnected via a communications network 160 (which may be either of, or a combination of a fixed-wire or wireless LAN, WAN, intranet, extranet, peer-to-peer network, virtual private network, the Internet, or other communications network) with a number of client computing environments such as tablet personal computer 210, mobile telephone 215, telephone 220, computing system 100, casino receptacle 217, personal digital assistant 225. In a network environment in which the communications network 160 is the Internet, for example, server 205 can be dedicated computing environment servers operable to process and communicate data to and from client computing environments 100, 210, 215, 217, 220, and 225 via any of a number of known protocols, such as, hypertext transfer protocol (HTTP), file transfer protocol (FTP), simple object access protocol (SOAP), or wireless application protocol (WAP). Additionally, networked computing environment 200 can utilize various data security protocols such as secured socket layer (SSL) or pretty good privacy (PGP). Each client computing environment 100, 210, 215, 217, 220, and 225 can be equipped with computing application 180 (i.e., an operating system) operable to support one or more computing applications, such as a web browser (not shown), or other graphical user interface (not shown), or a mobile desktop environment (not shown) to gain access to server computing environment 205.

In operation, a user (not shown) may interact with a computing application running on a client computing environment to obtain desired data and/or computing applications. The data and/or computing applications may be stored on server computing environment 205 and communicated to cooperating users through client computing environments 100, 210, 215, 217, 220, and 225, over exemplary communications network 160. A participating user may request access to specific data and applications housed in whole or in part on server computing environment 205. These data may be communicated between client computing environments 100, 210, 215, 217, 220, and 225 and server computing environments for processing and storage. Server computing environment 205 may host computing applications, processes and applets for the generation, authentication, encryption, and communication data and applications and may cooperate with other server computing environments (not shown), third party service providers (not shown), network attached storage (NAS) and storage area networks (SAN) to realize application/data transactions.

Figure 3:
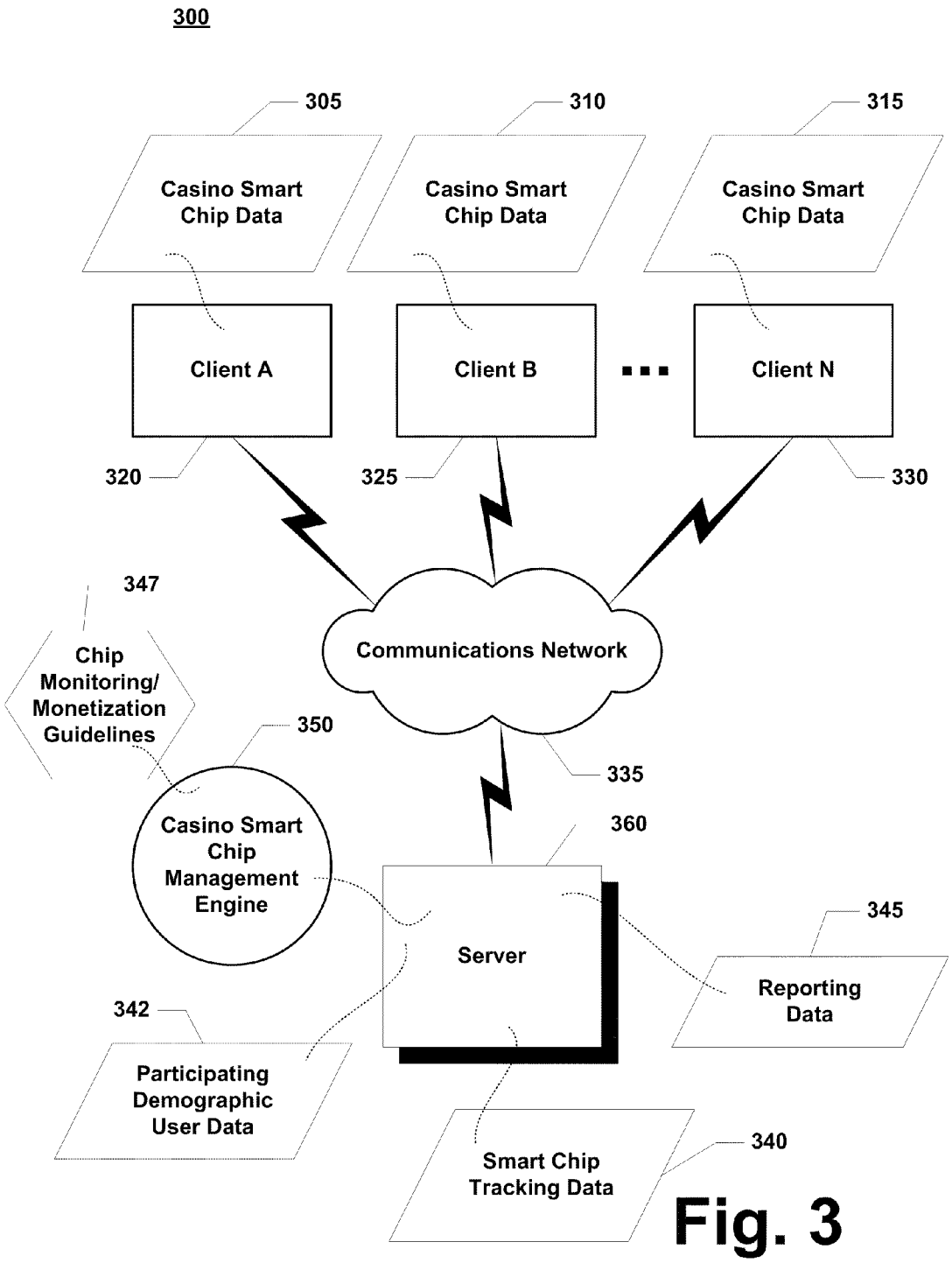
FIG. 3 is a block diagram showing the cooperation of exemplary components of an illustrative implementation in accordance with the herein described systems and methods.

Casino Smart Chip Management:

FIG. 3 shows an illustrative implementation of exemplary casino smart chip data environment 300. As is shown in FIG. 3, exemplary casino smart chip data environment 300 comprises client computing environment 320 (e.g., casino smart chip receptacle, such as a chip reader in a slot machine or at a gaming table), client computing environment 325 up to and including client computing environment 330, communications network 335, server computing environment 360, casino smart chip management engine 350, smart chip tracking data 340, participating user demographic data 342, reporting data 345, and chip monitoring/monetization guidelines 347. Also, as is shown in FIG. 3, casino smart chip data environment 300 can comprise casino smart chip data 305, 310, and 315 (e.g., including but not limited to monetary value data, demographic data, unique identifier data, etc.) which can be displayed, viewed, electronically transmitted, searched, copied, retrieved, annotated, navigated, and printed from client computing environments 320, 325, and 330, respectively.

In an illustrative operation, client computing environments 320, 325, and 330 can communicate with server computing environment 360 over communications network 335 to provide requests for and receive casino smart chip data 305, 310, and 315. In the illustrative operation, casino smart chip management engine 350 can execute one or more chip monitoring/monetization guidelines 347 executable on server computing environment 360 to provide one or more instructions to server computing environment 360 to process requests to retrieve casino smart chip data 305, 310, and 315 and to electronically communicate casino smart chip data 305, 310, and 315 to the requesting client computing environment (e.g., client computing environment 320, client computing environment 325, or client computing environment 330). As part of processing requests to generate and retrieve casino smart chip data 305, 310, and 315, casino smart chip management engine 350 can utilize a plurality of data including but not limited to smart chip tracking data 340. Additionally, in the illustrative operation, casino smart chip management engine 350 can generate for storage and subsequent reporting through reporting data 345 participating user demographic data 342. Also, as is shown in FIG. 3, client computing environments 320, 325, and 330 are capable of processing casino smart chip data 305, 310, and 315 using an exemplary computing application (not shown) for display and interaction to one or more participating users and/or cooperating parties (not shown).

Figure 4:
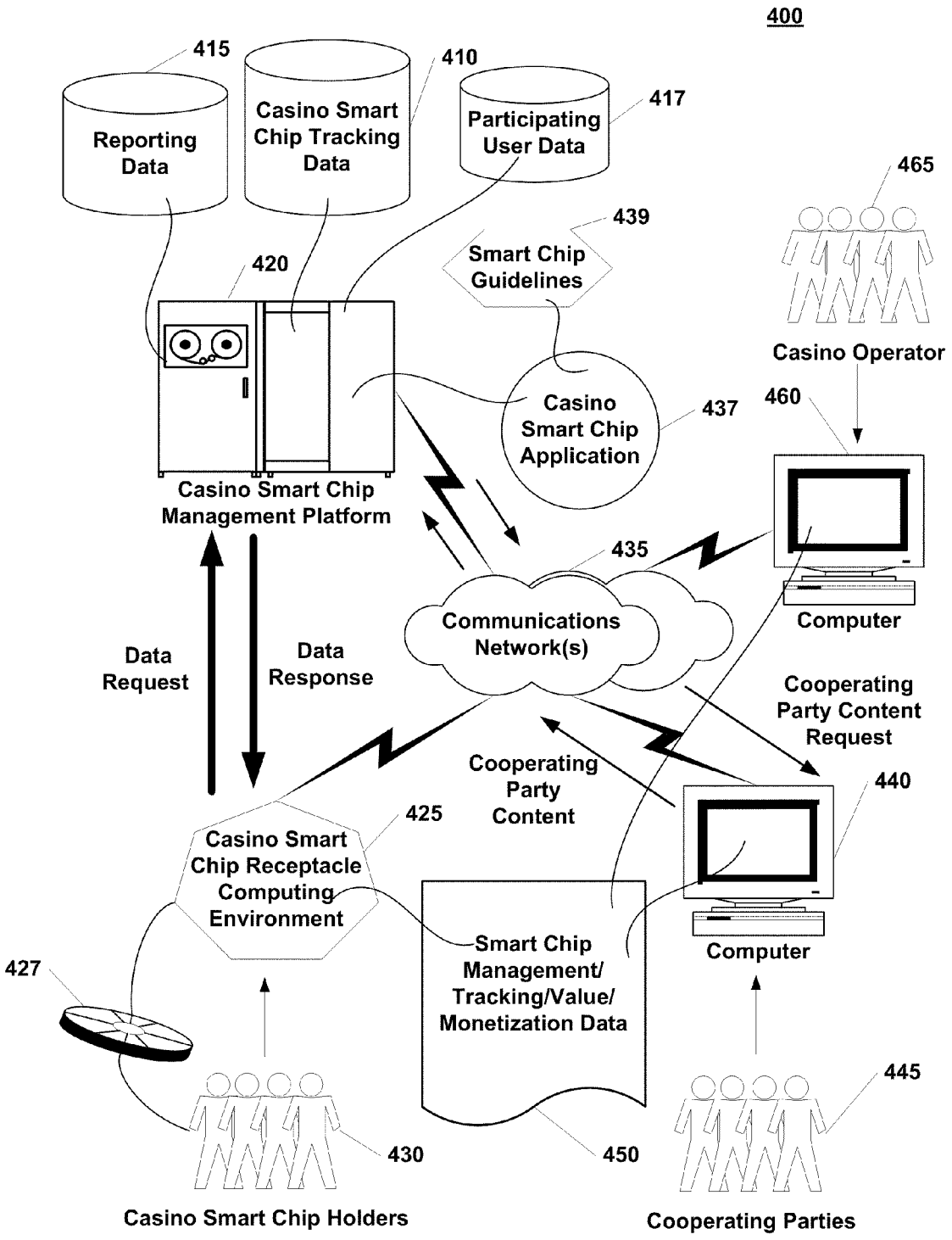
FIG. 4 is a block diagram showing an illustrative block representation of an illustrative implementation of an exemplary casino smart chip management system in accordance with the herein described systems and methods.

FIG. 4 shows a detailed illustrative implementation of an exemplary casino smart chip data environment 400. As is shown in FIG. 4, exemplary casino smart chip data environment 400 comprises casino smart chip management platform 420, reporting data store 415, participating user data store 417, smart chip tracking data store 410, casino smart chip application 437, smart chip guidelines 439, casino smart chip receptacle computing environment 425, casino smart chip holders 430, cooperating party computing environment 440, cooperating parties 445, operator computing environment 460, and casino operators 465. Further as is shown, casino smart chip holders 430 can interface with smart chip receptacle computing environment 425 to provide casino smart chip 427 as part of one or more selected casino smart chip tracking and/or monetization operations.

In an illustrative implementation, casino smart chip management platform 420 can be electronically coupled to casino smart chip receptacle computing environment 425, cooperating party computing environment 440, and operator computing environment 460 via communications network 435. In the illustrative implementation, communications network can comprise fixed-wire and/or wireless intranets, extranets, local area networks, wide area networks, and the Internet.

In an illustrative operation, casino smart chips 427 can be activated by casino smart chip management platform 420 according to a selected casino smart chip activation paradigm. In an illustrative operation, casino smart chip 427 can be read by a selected modality (e.g., RFID transceiver, magnetic strip, or bar code) operated by casino smart chip receptacle computing environment 425 to identify the casino smart chip's unique identifier. Casino smart chip management platform 420 can operate to authenticate casino smart chip 427 by cooperating with casino smart chip tracking data store 410 to retrieve data about casino smart chips and comparing the read unique identifier with casino smart chip data stored in casino smart chip tracking data store 410.

Additional authentication measures could be used, in order to thwart counterfeiting. For example, each token could include a set of rolling passwords that change each time the chip is used. Once authenticated, various data 450 about casino smart chip 427 can be provided to casino smart chip receptacle computing environment 425 by casino smart chip management platform 420 for display to casino smart chip holders (and casino personnel) including but not limited to the monetary value of the casino smart chip 427, rewards associated with the casino smart chip 427 (e.g., comps), and the source of the casino smart chip 427. Such data can be displayed by casino smart chip receptacle computing environment 425 and/or by a display area on casino smart chip 427.

Additionally, once authenticated, casino smart chip 427 can be used in a casino environment (not shown) to engage in various gaming and non-gaming activities based on the casino smart chip's 427 monetary/reward value including but not limited to playing non-table games, game table games, purchase products/services, and for security purposes (e.g., enter into a hotel room, VIP lounge, as part of a casino location tracking methodology).

In an illustrative operation, casino smart chip holders 430 can interact with casino smart chip receptacle computing environment 425 (e.g., a slot machine capable of accepting and processing casino smart chips, a gaming table having a reader to accept and process casino smart chips to monetize the value of a casino smart chip to a participating user—e.g., a casino smart chip holder 430) to provide a casino smart chip 427 for processing by the casino smart chip receptacle computing environment 425. In an illustrative implementation, casino smart chip holders 430 can be provided casino smart chips 427 as part of selected casino smart chip management paradigm (e.g., marketing promotion, reward program, etc.) and data about the casino smart chip holder 430 (e.g., participating user data) can be collected and communicated by one or more cooperating parties 445 (e.g., marketing promotion personnel—e.g., travel service) to casino smart chip management platform 420 over communications network 435. Casino smart chip management platform 420 can operatively process the participating user data according to one or more smart chip guidelines 439 executing on casino smart chip application 437 operative on casino smart chip management platform 420 to associate participating user data to specific casino smart chips 427 which are provided to the participating users as part of a selected process executed by casino smart chip management platform 420 to generate and track demographic data for processing and storage on participating user data store 417. In the illustrative implementation the demographic data can comprise data about the casino smart chip holder including but not limited to gender, race, age, residence, income, and other demographic data.

In the illustrative operation, the casino smart chip receptacle computing environment 425 can communicate with casino smart chip management platform 420 over communications network 435 to authenticate casino smart chips 427 and to provide tracking data of the use of casino smart chip 427 for processing according to smart chip guidelines 439 executing on casino smart chip application 437 operative on casino smart chip management platform 420 for storage by casino smart chip management platform 420 in casino smart chip tracking data store 410. In the illustrative operation, tracking data can comprise various data representative of the casino smart chip holder's activity in a gaming session (e.g., non-table gaming session and/or table gaming session).

In the illustrative operation, casino smart chip management platform 420 can process the received casino smart chip tracking data according to smart chip guidelines 439 executing on casino smart chip application 437 operative on casino smart chip management platform 420 to generate reporting data for storage on reporting data store 415 and for communication over communications network 435 to casino operator computing environment 460. In the illustrative operation, casino operators 465 can interact with casino operator computing environment cooperating with casino smart chip management platform 420 over communications network 435 to display, navigate, and modify reporting data, participating user data store 417, and/or casino smart chip tracking data.

In an illustrative implementation, casino smart chip 427 can be used in a casino environment (not shown) in a non-gaming context by providing the casino smart chip 427 to cooperating parties computing environment 440 (i.e., the cooperating parties computing environment operating a modality that can allow for the processing of casino smart chips—e.g., by passing it over a security check point, by providing to a product/service provider having a reader (not shown) which can cooperate with the provided casino smart chip 427. The received casino smart chip can be processed by cooperating parties computing environment 440 to generate data (e.g., data representative of the location of a casino smart chip in a casino environment, purchase of products/services in a casino/non-casino environment, etc.) and communicate the generated data over communications network 435 to casino smart chip management platform 420 for processing to generate demographic data (not shown) for storage in reporting data store 415 and for subsequent communication to casino operator computing environment 460 over communications network 435.

Figure 5:
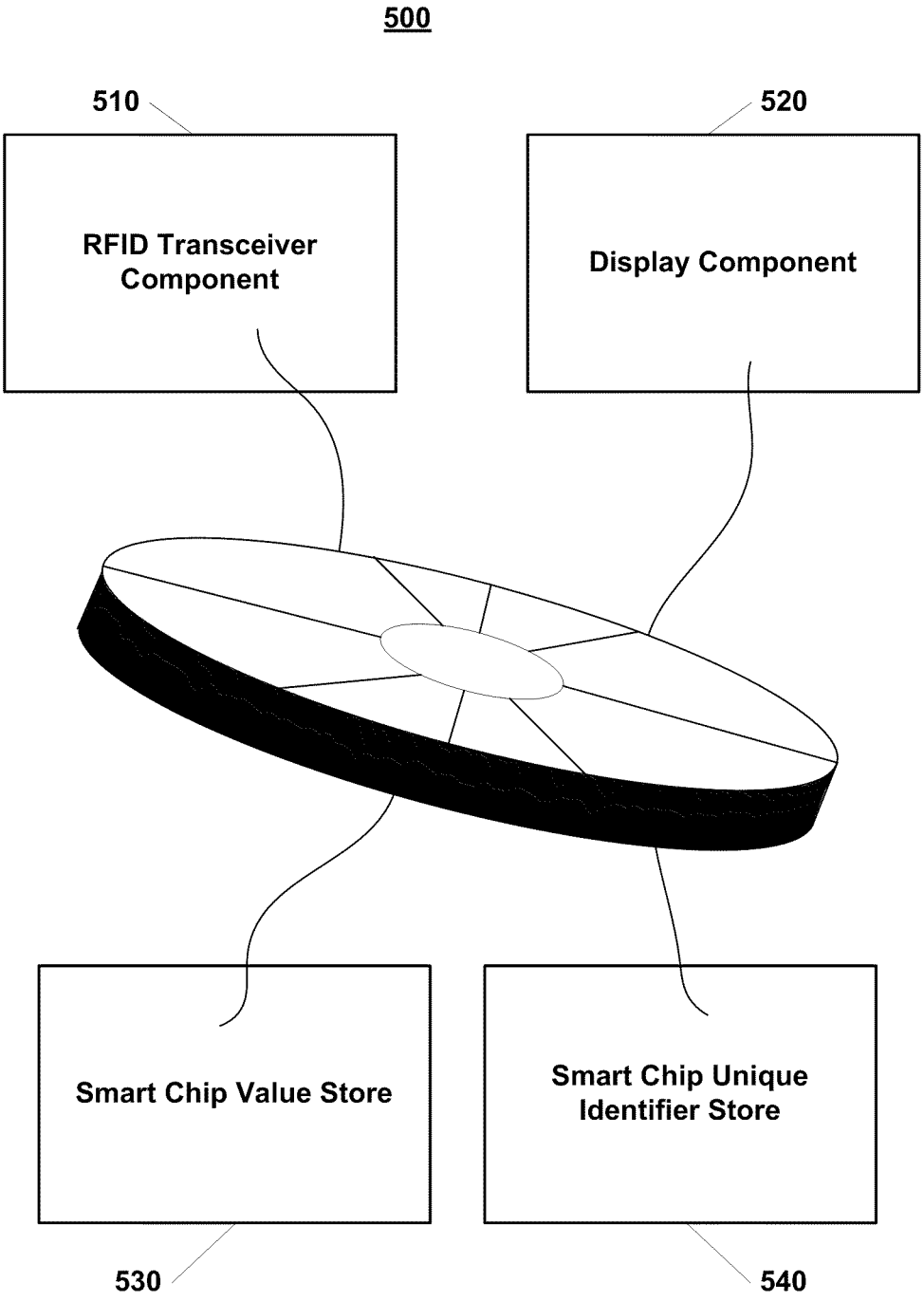
FIG. 5 is a block diagram of an exemplary casino smart chip in accordance with the herein described systems and methods.

FIG. 5 shows an exemplary casino smart chip 500. As is shown in FIG. 5, exemplary smart casino chip comprise one or more components including but not limited to radio frequency identification (RFID) transceiver component 510, display component 520, smart chip value store 530, and smart chip unique identifier store 540. In an illustrative implementation and operation, exemplary casino smart chip 500 can be used in a cooperative casino environment comprising one or more casino smart chip receptacle computing environments and/or with one or more cooperating parties (e.g., computing environments) to perform one or more selected casino smart chip operations including but not limited to casino smart chip monetization, casino smart chip tracking, security, and affinity marketing directed to casino smart chip holders.

In an illustrative implementation, RFID transceiver component 510 can be embedded in casino smart chip 500 to allow for various RFID data processing operations. Use of an RFID transceiver or other type of device that is non-contact readable is preferred for several reasons. Non-contact reading is more reliable than a contact reader, which is susceptible to damage or obstruction of the contact surface. In addition, non-contact readable devices, such as RFID transceivers, allow the location of the chip to be tracked more easily. For example, RFID reading devices could be positioned at entrances to and exits from the casino floor, in order to detect when a casino smart chip is taken from the casino floor (which could trigger enhanced authentication before the casino smart ship can be monetized). Further, in the illustrative implementation, display component 520 can comprise a liquid crystal display (LCD), hologram component, and back-light display component. In the illustrative implementation, smart chip value store 530 and smart chip unique identifier store 540 can comprise various volatile readable/re-writable computing memory mechanisms including but not limited to FLASH memory mechanisms.

Figure 6:
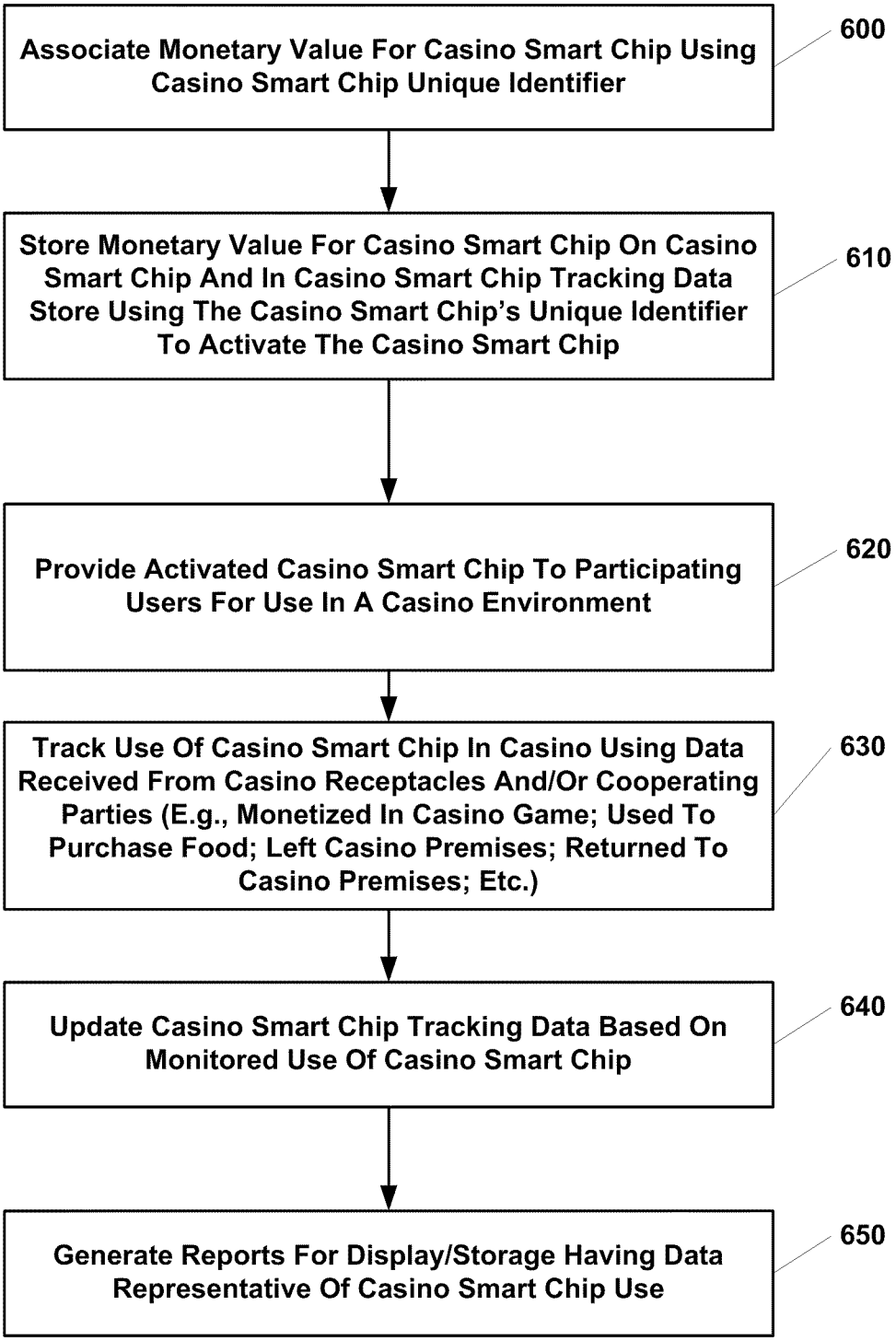
FIG. 6 is a flow diagram of illustrative processing performed to activate a casino smart chip in accordance with the herein described systems and methods.

FIG. 6 shows exemplary processing performed to activate an exemplary casino smart chip as described in FIG. 5 for use in an exemplary casino smart chip data environment as described in FIG. 4 to activate and commission a casino smart chip. As is shown, processing begins at block 600 where a monetary value is associated for a casino smart chip using a casino smart chip unique identifier. From there, processing proceeds to block 610 where the monetary value for the casino smart chip is stored on the casino smart chip and a casino smart chip tracking data store using the casino smart chip's unique identifier as a retrieval key to activate the casino smart chip. The activated casino smart chip is then provided to participating users at block 620 for use in a casino environment. Processing then proceeds to block 630 where the use of the casino smart chip in a casino and/or cooperating parties (e.g., monetized in a casino game, used to purchase food, tracked as part of leaving or returning to a casino's premises) is tracked. From there, processing proceeds to block 640 where the casino smart chip tracking data is updated based on the monitored/tracked use of a casino smart chip in a casino environment and/or cooperating parties. Reports are then generated for display/storage having data representative of casino smart chip use at block 650.

Figure 7:
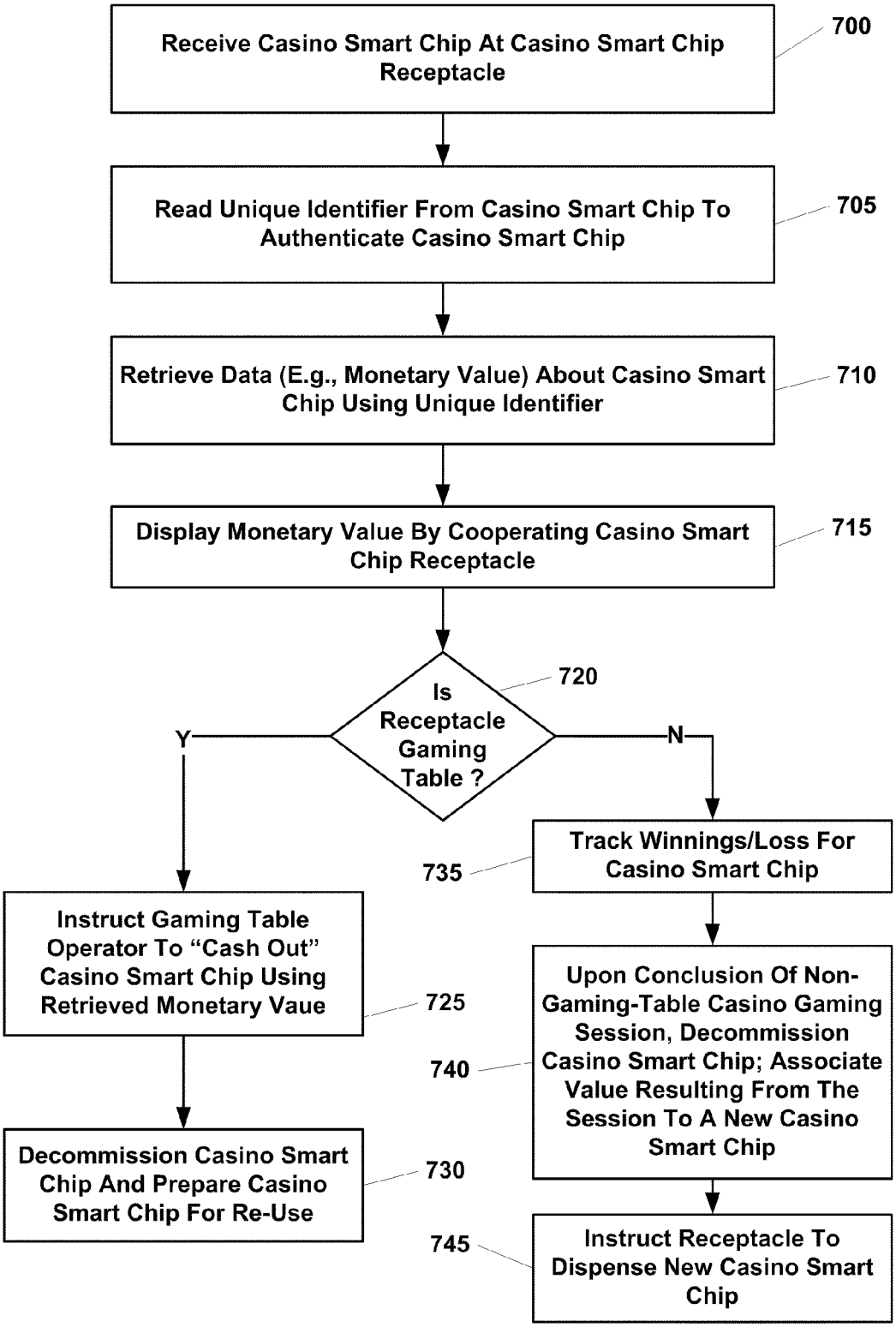
FIG. 7 is a flow diagram of illustrative processing performed when using a smart casino chip in a casino environment in accordance with the herein described systems and methods.

FIG. 7 shows other processing performed by an exemplary casino smart chip data environment 400 of FIG. 4 when tracking and managing a smart casino chip in context using a casino smart chip in a casino environment (e.g., gaming use). As is shown, processing begins at block 700 where a casino smart chip is received for processing at an exemplary casino smart chip receptacle. The unique identifier of the received casino smart chip is then read at block 705 to authenticate the casino smart chip. Data (e.g., monetary value; casino smart chip source—e.g., who provided the casino smart chip to the casino smart chip holder, who provided the casino smart chip to the casino smart chip receptacle) from the received smart chip is then retrieved at block 710 using the read/processed casino smart chip unique identifier. The monetary value can then be displayed by the cooperating casino smart chip receptacle at block 715. A check is then performed at block 720 to determine if the casino smart chip receptacle reading the casino smart chip is a gaming table.

If the check at block 720 indicates that the cooperating casino smart chip is placed at a gaming table and the casino smart chip is being read by the cooperating casino smart chip receptacle located at the gaming table, processing proceeds to block 725 where an instruction is generated and communicated to the gaming table by the casino smart chip management platform (e.g., 420 of FIG. 4) to the cooperating casino smart chip receptacle at the gaming table (i.e., and read by the gaming table operator) to "cash out" the casino smart chip according to the retrieved monetary value of the casino smart chip. Processing then proceeds to block 730 where the casino smart chip is decommissioned by the casino smart chip management platform (e.g., 420 of FIG. 4) and prepare the casino smart chip for re-use, redeployment, and reactivation processes.

However, if the check at block 720 indicates that the cooperating smart chip receptacle is not located at a gaming table (e.g., located at a slot machine, video poker machine, etc.), processing proceeds to block 735 where the winning/loss for the casino smart chip are tracked and communicated to the casino smart chip management platform (e.g., 420 of FIG. 4) for a gaming session. Processing then proceeds to block 740 where upon the conclusion of a non-gaming-table casino gaming session, the smart casino chip is decommissioned (e.g., the casino smart chip management platform performs one or more selected decommissioning processes to decommission the casino smart chip). Additionally at block 740, a new value resulting from the non-gaming-table casino gaming session (e.g., gains or losses) is associated to a new casino smart chip (unless the new value is zero). An instruction is then provided by the casino smart chip management platform to the cooperating non-gaming casino smart chip receptacle to dispense the new associated casino smart chip having the determined new value (e.g., value resulting from the non-gaming-table casino gaming session).

Figure 8:
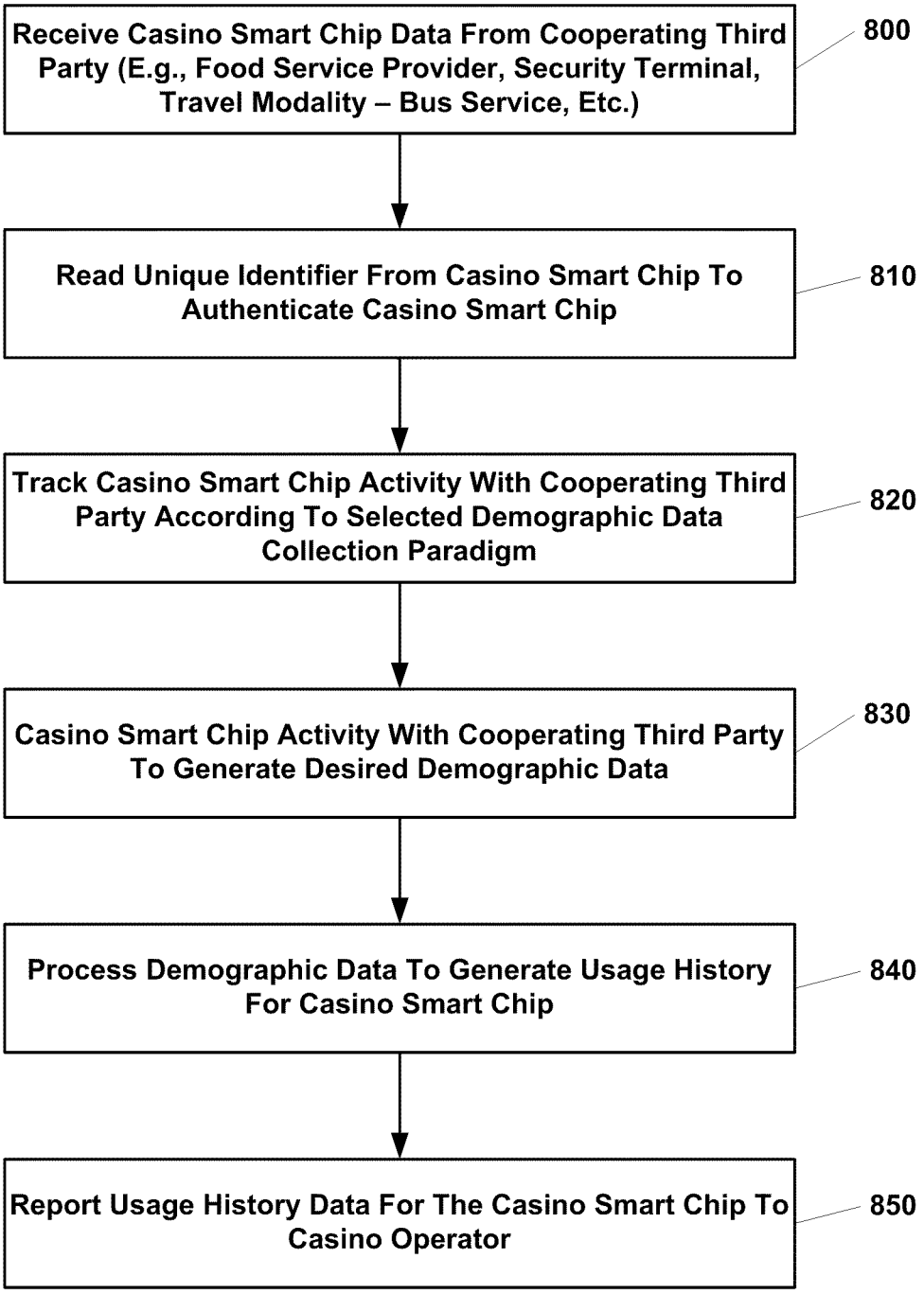
FIG. 8 is a flow diagram of illustrative processing performed when tracking a smart casino chip used in context of one or more cooperating third parties in accordance with the herein described systems and methods.

FIG. 8 shows other processing performed by an exemplary casino smart chip data environment 400 of FIG. 4 in an illustrative implementation to generate and store demographic data regarding the non-gaming use of a smart casino chip. As is shown, processing begins at block 800 where casino smart chip data provided by cooperating third parties (e.g., food service provider, security terminal, travel modality—e.g., bus service, travel agent, marketing outlet, etc.) is received by a casino smart chip management platform (e.g., 420 of FIG. 4). Processing then proceeds to block 810 where the unique identifier from the casino smart chip is read to authenticate the casino smart chip. Casino smart chip activity with cooperating third parties is then tracked by using cooperating casino smart chip readers (e.g., at security check points, food service areas, etc.) at block 820 according to a selected demographic data collection paradigm (e.g., track instances where a casino smart chip which was provided to a college student was used in food service area). The casino smart chip activity with cooperating third parties is then stored at block 830. The demographic data collected by cooperating third party casino smart chip readers is then processed at block 840 to generate usage history for the casino smart chip. The usage history data for the casino smart chip can then be reported to a casino operator at block 850.

The methods can be implemented by computer-executable instructions stored on one or more computer-readable media or conveyed by a signal of any suitable type. The methods can be implemented at least in part manually. The steps of the methods can be implemented by software or combinations of software and hardware and in any of the ways described above. The computer-executable instructions can be the same process executing on a single or a plurality of microprocessors or multiple processes executing on a single or a plurality of microprocessors. The methods can be repeated any number of times as needed and the steps of the methods can be performed in any suitable order.

The subject matter described herein can operate in the general context of computer-executable instructions, such as program modules, executed by one or more components. Generally, program modules include routines, programs, objects, data structures, etc., that perform particular tasks or implement particular abstract data types. Typically, the functionality of the program modules can be combined or distributed as desired. Although the description above relates generally to computer-executable instructions of a computer program that runs on a computer and/or computers, the user interfaces, methods and systems also can be implemented in combination with other program modules. Generally, program modules include routines, programs, components, data structures, etc. that perform particular tasks and/or implement particular abstract data types.

Moreover, the subject matter described herein can be practiced with most any suitable computer system configurations, including single-processor or multiprocessor computer systems, mini-computing devices, mainframe computers, personal computers, stand-alone computers, hand-held computing devices, wearable computing devices, microprocessor-based or programmable consumer electronics, and the like as well as distributed computing environments in which tasks are performed by remote processing devices that are linked through a communications network. In a distributed computing environment, program modules can be located in both local and remote memory storage devices. The methods and systems described herein can be embodied on a computer-readable medium having computer-executable instructions as well as signals (e.g., electronic signals) manufactured to transmit such information, for instance, on a network.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing some of the claims.

It is, of course, not possible to describe every conceivable combination of components or methodologies that fall within the claimed subject matter, and many further combinations and permutations of the subject matter are possible. While a particular feature may have been disclosed with respect to only one of several implementations, such feature can be combined with one or more other features of the other implementations of the subject matter as may be desired and advantageous for any given or particular application.

Moreover, it is to be appreciated that various aspects as described herein can be implemented on portable computing devices (e.g., field medical device), and other aspects can be implemented across distributed computing platforms (e.g., remote medicine, or research applications). Likewise, various aspects as described herein can be implemented as a set of services (e.g., modeling, predicting, analytics, etc.).

It is understood that the herein described systems and methods are susceptible to various modifications and alternative constructions. There is no intention to limit the herein described systems and methods to the specific constructions described herein. On the contrary, the herein described systems and methods are intended to cover all modifications, alternative constructions, and equivalents falling within the scope and spirit of the herein described systems and methods.

It should also be noted that the herein described systems and methods can be implemented in a variety of electronic environments (including both non-wireless and wireless computer environments), partial computing environments, and real world environments. The various techniques described herein may be implemented in hardware or software, or a combination of both. Preferably, the techniques are implemented in computing environments maintaining programmable computers that include a computer network, processor, servers, a storage medium readable by the processor (including volatile and non-volatile memory and/or storage elements), at least one input device, and at least one output device. Computing hardware logic cooperating with various instructions sets are applied to data to perform the functions described above and to generate output information. The output information is applied to one or more output devices. Programs used by the exemplary computing hardware may be preferably implemented in various programming languages, including high level procedural or object oriented programming language to communicate with a computer system. Illustratively the herein described apparatus and methods may be implemented in assembly or machine language, if desired. In any case, the language may be a compiled or interpreted language. Each such computer program is preferably stored on a storage medium or device (e.g., ROM or magnetic disk) that is readable by a general or special purpose programmable computer for configuring and operating the computer when the storage medium or device is read by the computer to perform the procedures described above. The apparatus can also be considered to be implemented as a computer-readable storage medium, configured with a computer program, where the storage medium so configured causes a computer to operate in a specific and predefined manner.

Although exemplary implementations of the herein described systems and methods have been described in detail above, those skilled in the art will readily appreciate that many additional modifications are possible in the exemplary embodiments without materially departing from the novel teachings and advantages of the herein described systems and methods. Accordingly, these and all such modifications are intended to be included within the scope of the herein described systems and methods.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The herein described systems and methods may be better defined by the following exemplary claims.

What is claimed is:

1. A system for managing casino smart chips comprising:

a casino smart chip management engine operable to receive data representative of a casino smart chip;

an instruction set comprising at least one instruction to instruct the casino smart chip management engine to process casino smart chip data to generate casino smart chip management data representative of the casino smart chip's activity in a selected environment, wherein the instruction set comprises at least one instruction to authenticate the casino smart chip by associating a unique chip identifier stored on the casino smart chip in a casino smart chip tracking data store, at least one instruction to assign the casino smart chip to an assigned casino patron, at least one instruction to designate a monetary value for the casino smart chip, and at least one instruction to change the designated monetary value for the casino smart chip based on the casino smart chip's activity by the assigned casino patron in the selected environment; and a plurality of casino smart chip receptacles distributed within the selected environment, wherein each casino smart chip receptacle is (i) cooperative with a corresponding casino game in the selected environment and (ii) operable to read data stored on the casino smart chip representative of the casino smart chip's unique chip identifier, wherein, after a casino smart chip receptacle reads the data stored on the casino smart chip for a gaming session at the corresponding casino game, the system automatically decommissions the casino smart chip.

2. The system as recited in claim 1, further comprising one or more data stores operable to store data comprising casino smart chip tracking data, reporting data, demographic data, and data representative of participating users that deploy one or more casino smart chips in a casino and/or non-casino environment.

3. The system as recited in claim 2, wherein the casino smart chip management engine is operable to process received casino smart chip data to generate management data comprising casino smart chip track data, reporting data, demographic data, and data representative of participating users that deploy one or more casino smart chips in a casino and/or non-casino environment.

4. The system as recited in claim 2, wherein the casino smart chip management engine comprises a computing application operable on a computing environment.

5. The system as recited in claim 4, wherein each casino smart chip receptacle is operable to physically receive the casino smart chip and read the data stored on the casino smart chip representative of the casino smart chip's unique chip identifier.

6. The system as recited in claim 5, wherein each casino smart chip receptacle comprises a display operable to provide data representative of the casino smart chip comprising monetary value, reward value, location data, and origin of source data.

7. The system as recited in claim 1, further comprising one or more cooperating computing environments operable to cooperate with the casino smart chip management engine to communicate, retrieve, and process data representative of the casino smart chip's activity and/or characteristics.

8. The system as recited in claim 7, wherein the one or more computing environments comprise a casino operator computing environment.

9. The system as recited in claim 8, wherein the one or more computing environments are operable to display data representative of the casino smart chip data comprising casino smart chip tracking data, reporting data, demographic data, and data representative of participating users that deploy one or more casino smart chips in a casino and/or non-casino environment for navigation, modification, subsequent processing, and/or storage in one or more cooperating data stores.

10. The invention of claim 1, wherein:

the casino smart chip has no inherent, minimum, nonzero monetary value; and the casino smart chip can be designated with any of a plurality of different monetary values including zero and two or more different non-zero values.

11. The invention of claim 1, wherein each casino smart chip receptacle comprises an RFID reader configured to communicate with an RFID transceiver in the casino smart chip to read the data stored on the casino smart chip.

12. The invention of claim 1, wherein:

a casino smart chip receptacle is configured to cooperate with a gaming session at a gaming table; and after the casino smart chip receptacle reads the data stored on the casino smart chip, the system (i) cashes out the casino smart chip based on a monetary value assigned to the casino smart chip and (ii) automatically decommissions the casino smart chip.

13. The invention of claim 1, wherein:

a casino smart chip receptacle is configured to cooperate with a gaming session at a non-gaming-table machine; and after the casino smart chip receptacle reads the data stored on the casino smart chip, the system (i) tracks winnings/losses for the casino smart chip during the gaming session and (ii) upon conclusion of the gaming session, automatically decommissions the casino smart chip.

14. The invention of claim 13, wherein, upon the conclusion of the gaming session, the system dispenses a new casino smart chip having an associated, new monetary value resulting from the winnings/losses during the gaming session.

15. A computer-based system for a casino smart chip (CSC) having a unique CSC identifier, the system comprising:

a CSC database operable to store CSC data associated with the casino smart chip;

a computer-implemented CSC manager operable to (i) designate a CSC monetary value for the casino smart chip, (ii) assign the casino smart chip to an assigned casino patron, and (iii) store the unique CSC identifier, data representing the assigned casino patron, and the designated CSC monetary value for the casino smart chip in the CSC database, such that the system tracks activity of the casino smart chip by the assigned casino patron; and a plurality of CSC receptacles distributed within the selected environment, wherein each CSC receptacle is (i) cooperative with a corresponding casino game in the selected environment and (ii) operable to read data stored on the casino smart chip representative of the casino smart chip's unique chip identifier, wherein, after a CSC receptacle reads the data stored on the casino smart chip for a gaming session at the corresponding casino game, the system automatically decommissions the casino smart chip.

16. The invention of claim 15, wherein the CSC manager is operable to store, in the CSC database, demographic data for the assigned casino patron using the casino smart chip.

17. The invention of claim 15, wherein the CSC manager is operable to selectively activate and de-activate the casino smart chip, such that, when the casino smart chip is de-activated, the CSC manager sets the designated CSC monetary value for the casino smart chip to be zero.

18. The invention of claim 17, wherein, after the CSC manager has de-activated the casino smart chip for the assigned casino patron, the CSC manager is operable to re-activate the de-activated casino smart chip for subsequent use by another casino patron.

19. The invention of claim 15, wherein the CSC manager is operable to:

(1) receive data corresponding to CSC use of the casino smart chip by the assigned casino patron; and (2) modify the designated CSC monetary value for the casino smart chip stored in the CSC database based on the CSC use by the assigned casino patron.

20. The invention of claim 19, wherein the CSC use by the assigned casino patron is for non-gaming activity.

21. The invention of claim 19, wherein the CSC manager is operable to (i) track the CSC use of the casino smart chip by the assigned casino patron in the CSC database and (ii) generate reports about the CSC use of the casino smart chip by the assigned casino patron.

22. The invention of claim 15, wherein each CSC receptacle is operable to determine and transmit the unique CSC identifier to the CSC manager, wherein:

the CSC manager is operable to (i) retrieve the designated CSC monetary value from the CSC database based on the unique CSC identifier received from a CSC receptacle and (ii) transmit the designated CSC monetary value to the CSC receptacle to authorize CSC use of the casino smart chip by the assigned casino patron.

23. The invention of claim 22, wherein the CSC receptacle is part of a slot machine, a video poker game, or a gaming table.

24. The invention of claim 23, wherein the CSC manager is operable to process the CSC data differently when the CSC receptacle is part of a gaming table than when the CSC receptacle is part of a slot machine or a video poker machine.

25. The invention of claim 22, wherein the CSC receptacle comprises an electronic display component operable to display the designated CSC monetary value received from the CSC manager.

26. The invention of claim 22, wherein the CSC receptacle comprises a RFID reader operable to interrogate an RFID transceiver in the casino smart chip for the unique CSC identifier of the casino smart chip.

27. The invention of claim 22, wherein the CSC receptacle is operable to transmit the designated CSC monetary value received from the CSC manager to the casino smart chip for storage of the designated CSC monetary value in CSC computer memory in the casino smart chip.

28. The invention of claim 22, wherein the CSC manager is operable to transmit to the CSC receptacle instructions to cash out the casino smart chip for the designated CSC monetary value.

29. The invention of claim 28, wherein, after the casino smart chip has been cashed out, the CSC manager is operable to de-activate the casino smart chip by updating the designated CSC monetary value stored in the CSC database to be zero.

30. The invention of claim 22, wherein the CSC manager is operable to:

(1) track winnings and/or losings by the assigned casino patron associated with the casino smart chip to determine an updated CSC monetary value for the casino smart chip;

(2) de-activate the casino smart chip by setting the corresponding designated CSC monetary value in the CSC database to be zero;

(3) activate a different casino smart chip by designating the different casino smart chip to have the updated CSC monetary value in the CSC database; and (4) instruct the CSC receptacle to dispense the different casino smart chip to the assigned casino patron.

31. The invention of claim 15, wherein:

the CSC manager is operable to store, in the CSC database, demographic data for the assigned casino patron using the casino smart chip;

the CSC manager is operable to selectively activate and de-activate the casino smart chip, such that, when the casino smart chip is de-activated, the CSC manager sets the designated CSC monetary value for the casino smart chip to be zero;

after the CSC manager has de-activated the casino smart chip for the assigned casino patron, the CSC manager is operable to re-activate the de-activated casino smart chip for subsequent use by another casino patron;

the CSC manager is operable to:

(1) receive data corresponding to CSC use of the casino smart chip by the assigned casino patron; and (2) modify the designated CSC monetary value for the casino smart chip stored in the CSC database based on the CSC use by the assigned casino patron;

the CSC manager is operable to track the CSC use of the casino smart chip by the assigned casino patron in the CSC database;

the CSC manager is operable to generate reports about the CSC use of the casino smart chip by the assigned casino patron; and each CSC receptacle is operable to determine and transmit the unique CSC identifier to the CSC manager, wherein:

the CSC manager is operable to (i) retrieve the designated CSC monetary value from the CSC database based on the unique CSC identifier received from a CSC receptacle and (ii) transmit the designated CSC monetary value to the CSC receptacle to authorize CSC use of the casino smart chip by the assigned casino patron;

the CSC receptacle is part of a slot machine, a video poker game, or a gaming table;

the CSC manager is operable to process the CSC data differently when the CSC receptacle is part of a gaming table than when the CSC receptacle is part of a slot machine or a video poker machine;

the CSC receptacle comprises an electronic display component operable to display the designated CSC monetary value received from the CSC manager;

the CSC receptacle comprises a RFID reader operable to interrogate an RFID transceiver in the casino smart chip for the unique CSC identifier of the casino smart chip;

the CSC receptacle is operable to transmit the designated CSC monetary value received from the CSC manager to the casino smart chip for storage of the designated CSC monetary value in CSC computer memory in the casino smart chip;

the CSC manager is operable to transmit to the CSC receptacle instructions to cash out the casino smart chip for the designated CSC monetary value;

after the casino smart chip has been cashed out, the CSC manager is operable to de-activate the casino smart chip by updating the designated CSC monetary value stored in the CSC database to be zero; and the CSC manager is operable to:

(1) track winnings and/or losings by the assigned casino patron associated with the casino smart chip to determine an updated CSC monetary value for the casino smart chip;

(2) de-activate the casino smart chip by setting the corresponding designated CSC monetary value in the CSC database to be zero;

(3) activate a different casino smart chip by designating the different casino smart chip to have the updated CSC monetary value in the CSC database; and (4) instruct the CSC receptacle to dispense the different casino smart chip to the assigned casino patron.

32. The invention of claim 15, wherein the casino smart chip comprises:

a unique CSC identifier that the CSC manager stores in the CSC database along with a CSC monetary value for the casino smart chip that is designated by the CSC manager; and memory operable to store the designated CSC monetary value for the casino smart chip, wherein:

the casino smart chip has no inherent, minimum, non-zero monetary value; and the casino smart chip can be designated with any of a plurality of different monetary values including zero and two or more different non-zero values.

33. The invention of claim 32, wherein the casino smart chip comprises an RFID transceiver operable to (i) store the unique CSC identifier for the casino smart chip and (ii) transmit the unique CSC identifier to an RFID reader of the system.

34. The invention of claim 32, wherein the casino smart chip further comprises a receiver operable to receive the designated CSC monetary value from the CSC manager.

35. The invention of claim 32, wherein the casino smart chip comprises an electronic display component operable to display the designated CSC monetary value for the casino smart chip.

36. The invention of claim 32, wherein the casino smart chip comprises:

an RFID transceiver operable to (i) store the unique CSC identifier for the casino smart chip and (ii) transmit the unique CSC identifier to an RFID reader of the system;

a receiver operable to receive the designated CSC monetary value from the CSC manager; and an electronic display component operable to display the designated CSC monetary value for the casino smart chip.

37. The invention of claim 15, wherein:

the casino smart chip has no inherent, minimum, nonzero monetary value; and the casino smart chip can be designated with any of a plurality of different monetary values including zero and two or more different non-zero values.

38. The invention of claim 15, wherein:

a CSC receptacle is configured to cooperate with a gaming session at a gaming table; and after the CSC receptacle reads the data stored on the casino smart chip, the system (i) cashes out the casino smart chip based on a monetary value assigned to the casino smart chip and (ii) automatically decommissions the casino smart chip.

39. The invention of claim 15, wherein:

a CSC receptacle is configured to cooperate with a gaming session at a non-gaming-table machine; and after the CSC receptacle reads the data stored on the casino smart chip, the system (i) tracks winnings/losses for the casino smart chip during the gaming session and (ii) upon conclusion of the gaming session, automatically decommissions the casino smart chip.

40. The invention of claim 39, wherein, upon the conclusion of the gaming session, the system dispenses a new casino smart chip having an associated, new monetary value resulting from the winnings/losses during the gaming session.

* * * * *